US009945555B2

(12) United States Patent
Cruz

(10) Patent No.: US 9,945,555 B2
(45) Date of Patent: Apr. 17, 2018

(54) MULTI-AIR CHAMBER BURNER WITH SWIRL GENERATOR

(71) Applicant: Pedro Hernandez Cruz, Irapuato (MX)

(72) Inventor: Pedro Hernandez Cruz, Irapuato (MX)

( * ) Notice: Subject to any disclaimer, the term of this patent is extended or adjusted under 35 U.S.C. 154(b) by 0 days.

(21) Appl. No.: 14/733,293

(22) Filed: Jun. 8, 2015

(65) Prior Publication Data

US 2017/0241640 A1 Aug. 24, 2017

(51) Int. Cl.

| | |
|---|---|
| ***F23C 7/00*** | (2006.01) |
| ***F23D 14/02*** | (2006.01) |
| ***F23D 14/58*** | (2006.01) |
| ***F23D 14/62*** | (2006.01) |
| ***F23D 14/70*** | (2006.01) |

(52) U.S. Cl.

CPC ..... *F23D 14/02* (2013.01); *F23D 14/58* (2013.01); *F23D 14/62* (2013.01); *F23D 14/70* (2013.01)

(58) Field of Classification Search

CPC ..... F23C 7/002
USPC ..... 431/353; 366/25
See application file for complete search history.

(56) References Cited

U.S. PATENT DOCUMENTS 2,497,321 A 2/1950 Pattinson et al.
4,559,009 A 12/1985 Marino et al.
4,708,637 A 11/1987 Dutescu
4,741,279 A * 5/1988 Azuhata ..... F23C 7/004 110/264
4,938,019 A 7/1990 Angell et al.
5,020,987 A * 6/1991 Ishiguro ..... F23C 15/00 431/1
5,538,340 A * 7/1996 Brashears ..... E01C 19/1036 366/147
7,163,392 B2 1/2007 Feese et al.

* cited by examiner

*Primary Examiner* — Avinash Savani
(74) *Attorney, Agent, or Firm* — Gary W Hamilton

(57) ABSTRACT

A burner is disclosed for generating flame and heat. The burner includes a first stage, a second stage downstream of the first stage, a third stage downstream of the first and second stages, and a fourth stage downstream of the first, second, and third stages. The first stage comprises a first innermost air chamber and a first mixing chamber for air and fuel, wherein the first stage includes separate conduits for air and fuel, and wherein the air and fuel begin to mix in the first mixing chamber during use to form an air/fuel mixture. The second stage comprises a second mixing chamber which comprises a deflection plate to force the air/fuel mixture outward from the centerline. The third stage comprises a combustion zone. The combustion zone includes a swirl generator. The swirl generator has an inner diameter greater than an outer diameter of the deflection plate. The swirl generator produces a swirl, whirl, vortex, or the like in the flame during operation.

16 Claims, 6 Drawing Sheets

MULTI-AIR CHAMBER BURNER WITH SWIRL GENERATOR

TECHNICAL FIELD OF THE INVENTION

This invention relates to burner devices, including but not limited to industrial burners used to heat buildings.

BACKGROUND

Burners are well known devices. For example, U.S. Pat. No. 4,708,637 discloses a gaseous fuel reactor which is composed of a plurality of concentric casings which form a primary air chamber, a secondary air chamber, and a tertiary air chamber. This patent states the flow of gas and air through the various chambers interact to provide controlled flame characteristics. Also, the flame is maintained at a lower temperature to avoid the formation of pollutants.

Improvements to burners remain desirable, including burners with reduced emissions and lower fuel consumption for a given amount of heating.

SUMMARY OF THE INVENTION

The present invention provides a solution to one or more of the problems or desired outcomes described above.

In one broad respect, this invention is a burner, comprising: a first stage, a second stage downstream of the first stage, and a third stage downstream of the first and second stages. The first stage comprises an innermost air chamber, a fuel conduit having fuel ports positioned at a distal end of the innermost air chamber, and a first mixing chamber distal to the fuel source, wherein the innermost air chamber and first mixing chamber includes ports conduits for air. The second stage comprises a second mixing chamber and a deflector plate, wherein the deflector plate is positioned at a distal end of the second mixing chamber. The third stage comprises a swirl generator and a combustion zone, wherein the swirl generator has an inner diameter greater than an outer diameter of the deflection plate.

During operation of the burner, gaseous flow comprising the air/fuel mixture is forced around the deflection plate into the combustion zone. Air simultaneously passes through the swirl generator. The deflection plate contains the flow of the air/fuel mixture, which comes projected with force from the interior of the burner. In this way the deflection plate prevents the base of the flame to be too far from the end of the burner, thereby preventing an unstable, easily extinguishable flame. The deflection plate also serves to modify the form of the flame, from a mainly rectilinear from with the centerline toward a flame with an extended circular projection coaxial with the centerline. With a rectilinear form, the heat is projected is projected to the center of the circle, being restricted to transfer heat by only covering a small area. The deflection plate permits an extended circular flame projection to thereby favoring heat transfer outward from the centerline, thus providing a larger area of heat transfer. The air from the swirl generator is projected into the combustion zone so that the flame forms into a vortex or whirl.

In another broad respect, this invention is a burner device, comprising: an innermost air chamber, a first inner mixing chamber which is distal to the innermost air chamber, and a second inner mixing chamber which is distal to the first mixing chamber; a first air inlet coaxial chamber which surrounds the innermost air chamber and the first mixing chamber; a second air inlet coaxial chamber which surrounds the first air inlet coaxial chamber; a third air inlet coaxial chamber which surrounds the second air inlet coaxial chamber and the second mixing chamber, said third air inlet coaxial chamber including ports for air to flow into the second air inlet coaxial chamber; a deflection plate positioned on the distal end of the second mixing chamber; wherein the second mixing chamber connects to a combustion zone which is distal from the second mixing chamber; wherein said third air inlet coaxial chamber has a distal end that connects to a coaxial static swirl generator; and a fuel conduit extending up to the first inner mixing chamber through an opening in the innermost air chamber.

In one embodiment, the first mixing chamber has a first end and a second end, said second end being downstream from the first end, and said second end opening into the second mixing chamber. In another embodiment, said first air inlet coaxial chamber includes ports that allow air to flow from the first air inlet coaxial air inlet chamber into the innermost mixing chamber and the first mixing chamber, and wherein said first air inlet coaxial chamber has a distal end coterminous with the second end of the first inner mixing chamber. In another embodiment, said distal end of the second air inlet coaxial chamber is coterminous with the distal end of the first air inlet coaxial chamber, and said second air inlet coaxial chamber including ports for air to flow into the first air inlet coaxial chamber. In another embodiment, the deflection plate is circular. In another embodiment, the deflection plate has an outer diameter less than the outer diameter of the second mixing chamber, and wherein the outer diameter of the circular deflection plate is greater than the outer diameter of the first inner mixing chamber. In another embodiment, the outer diameter of the deflection plate is coaxial with the centerline, and wherein the deflection plate during operation directs the flow of the air/fuel mixture outward from the centerline and into the combustion zone. In another embodiment, said coaxial static swirl generator comprises fins configured to direct air flow into the combustion zone. In another embodiment, said static coaxial swirl generator has an inner diameter greater than the outer diameter of the deflection plate. In another embodiment, said static coaxial swirl generator is positioned co-longitudinal along the centerline with the deflection plate. In another embodiment, a portion of the first air inlet chamber and the second air inlet chamber converge downstream. In another embodiment, the device includes ports that allow to gaseous interchange between the first inner mixing chamber and the first air inlet coaxial air inlet chamber. In another embodiment, the first and second air inlet coaxial chambers have ends at same distance distally along the centerline. In another embodiment, said second air inlet coaxial chamber includes ports for gaseous interchange with the first air inlet coaxial chamber. In another embodiment, said third air inlet coaxial chamber couples to an air blower. In another embodiment, said second air inlet coaxial chamber includes at least one distal opening for air to flow into the second mixing chamber. In another embodiment, the device further comprises an ignitor positioned within the combustion zone.

In another broad respect, this invention is a method of manufacturing a burner, comprising: forming a first stage, a second stage downstream of the first stage, and a third stage downstream of the first and second stages, wherein the first stage comprises an innermost air chamber, a fuel conduit, and a first mixing chamber for air and fuel, wherein the air and fuel begin to mix in the first mixing chamber during operation to form an air/fuel mixture; wherein the second stage comprises a second mixing chamber which comprises a deflection plate; wherein the third stage comprises a combustion zone and includes a swirl generator, wherein the swirl generator has an inner diameter greater than an outer diameter of the deflection plate.

In another broad respect, this invention is a method of forming a flame, comprising: providing a burner, comprising: a first stage, a second stage downstream of the first stage, and a third stage downstream of the first and second stages, wherein the first stage comprises an innermost air chamber, a fuel conduit, and first mixing chamber for air and fuel, wherein the air and fuel begin to mix in the first mixing chamber during operation to form an air/fuel mixture, wherein the second stage comprises a second mixing chamber which comprises a deflection plate, wherein the third stage comprises a combustion zone and a swirl generator, flowing air into the first and second stages and simultaneously flowing fuel into the first stage; igniting a flame in the combustion zone; wherein an air/fuel mixture formed in the second stage moves around the deflection plate into the combustion zone, wherein air passes through the swirl generator into the combustion zone to cause the flame to swirl.

Stated differently, the device includes a body defining coaxial (concentric) chambers positioned relative to a longitudinal centerline. The body also includes an innermost air chamber that flows into a first inner mixing chamber which opens distally into a second mixing chamber. The second mixing chamber can also be referred to as a pre-combustion chamber. A first air inlet coaxial chamber surrounds the innermost air chamber and the first mixing chamber. The first air inlet coaxial chamber including ports that allow air to flow from the first air inlet coaxial air inlet chamber into the innermost air chamber as well as into the first inner mixing chamber. The device includes a second air inlet coaxial chamber which surrounds the first air inlet coaxial chamber. The second air inlet coaxial chamber including ports for air to flow into the first air inlet coaxial chamber. The device includes a third air inlet coaxial chamber which surrounds the second air inlet coaxial chamber and the second mixing chamber. In addition, the device includes a circular deflection plate positioned on the distal end of the second mixing chamber. The circular deflection plate has an outer diameter less than the outer diameter of the second mixing chamber, and the outer diameter of the circular deflection plate can be greater than the outer diameter of the first inner mixing chamber. The outer diameter of the circular plate is coaxial with the centerline. During operation the deflection plate directs the flow of the air/fuel mixture outward from the centerline and into a combustion zone, wherein the combustion zone is distal/downstream from the second mixing chamber. The third air inlet coaxial chamber has a distal end that connects to a coaxial static swirl generator. The coaxial static swirl generator can be composed of fins, baffles, or the like to create turbulence (swirl) in gas flowing through and over the fins. The swirl generator is configured to direct air flow into the flow of the air/fuel mixture in the combustion zone to thereby create a whirl or vortex of the flame. Likewise, the static coaxial swirl generator can have an inner diameter greater than the outer diameter of the deflection plate. In general, the static coaxial swirl generator is positioned co-longitudinal along the centerline with the deflection plate. The device includes a fuel conduit extending into the first inner mixing chamber and with an opening in the first inner mixing.

The device of this invention provides excellent combustion of gas. The device provided improved fuel consumption relative to a commercially available Winterwarm brand burner from The Netherlands. Importantly, the burner of this invention provides improved combustion with low emissions and low odor.

The burner device of this invention can be used in a wide range of end uses, including but not limited to industrial burners for buildings, agricultural applications such as greenhouses, fruit orchards, and so on, livestock and animal heating, domestic heating, commercial and industrial heating, and so on.

DESCRIPTION OF THE DRAWINGS

It is noted that the appended drawings illustrate only exemplary embodiments of the invention and are, therefore, not to be considered limiting of its scope, for the invention may admit to other equally effective embodiments.

DETAILED DESCRIPTION OF THE INVENTION

Figure 1:
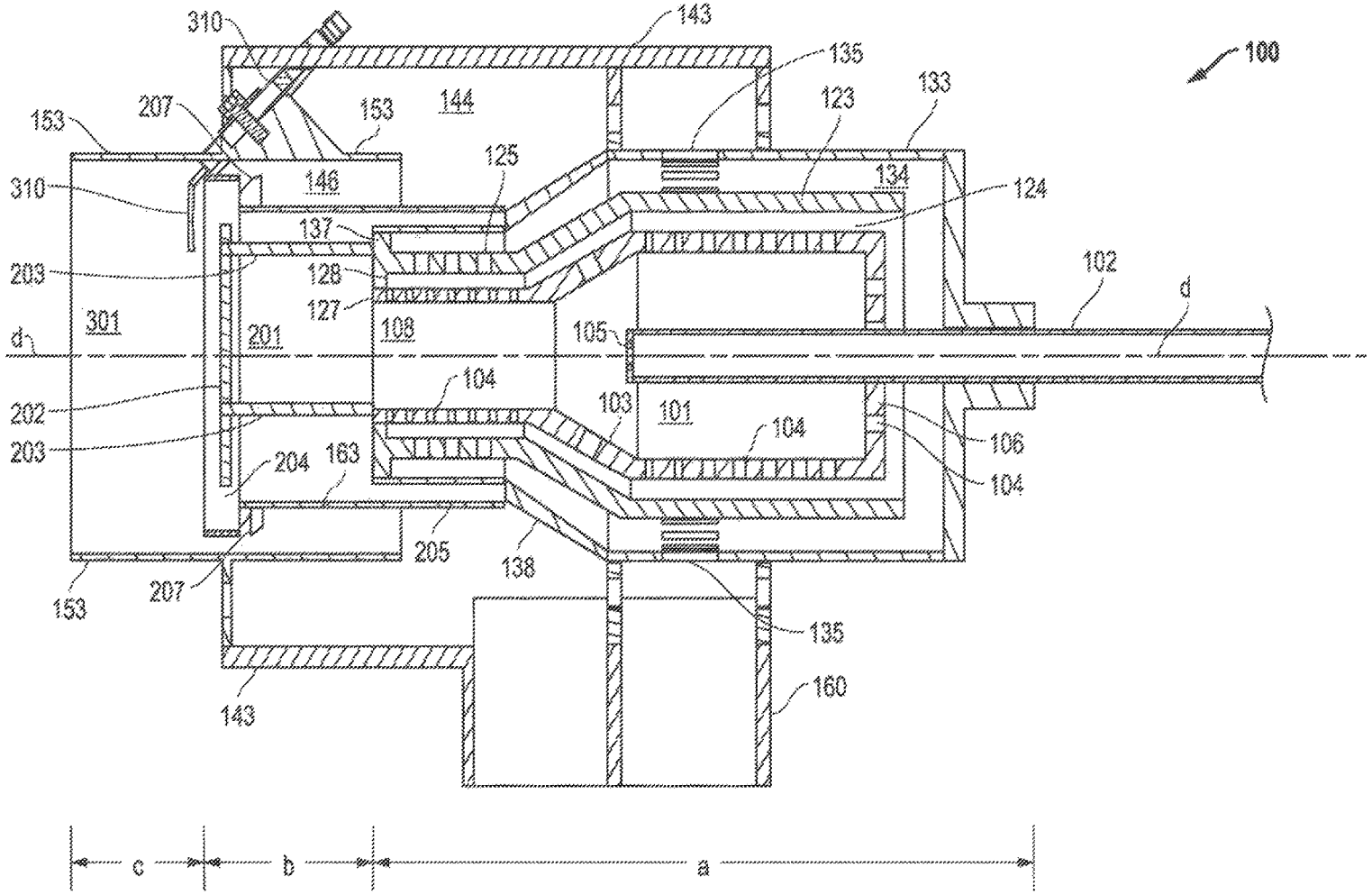
FIG. 1 shows a cross-section of the burner of this invention.

The present invention provides a burner, which can also be referred to as a combustion device. Referring to FIG. 1, the burner includes a first stage "a," a second stage "b" downstream of the first stage, and a third stage "c" downstream of the first and second stages. By downstream it is meant downstream in the direction of gas flow during operation of the burner. Gas moves from the first stage "a" through to the third stage "c."

The first stage "a" comprises an innermost air chamber 101. As used herein, the term "chamber" refers to a void or bore. As used herein, chamber, passage, enclosed space, and cavity have essentially the same meaning. Fuel conduit 102 supplies fuel to the first mixing chamber 108. The fuel conduit 102 can be constructed of a capped pipe which includes ports 105 on the tip of the conduit 102. Fuel can flow through the ports 105 into the first mixing chamber 108. Alternatively, the fuel conduit 102 can be uncapped (open ended). Likewise, the conduit can include ports along the length of the pipe, in which case the innermost air chamber 101 becomes part of the first mixing chamber. The length and size of the fuel conduit 102 can vary depending on the overall dimensions of the burner 100, flow rate of fuel, flow rate of the air, air/fuel mix ratio, and so on.

The fuel is typically gaseous at operating temperatures. For example, the fuel can be natural gas, propane, or other hydrocarbon fuel.

The innermost air chamber 101 and the first mixing chamber 108 include air conduits 104, which can also be referred to as ports, in the inner coaxial housing 103 that defines and forms the first mixing chamber 108 and the innermost air chamber 101. The inner coaxial housing 103 is one of multiple concentric housings that surround the centerline "d" of the device, such housings forming chambers (voids) within the body 100 of the burner. Thus, the body includes middle housing 123 and outer housing 133. The inner housing 103 and middle housing 123 together form a first air inlet coaxial chamber 124. The middle housing 123 and the outer housing 133 are configured and designed to form the second air inlet coaxial chamber 134. An outermost housing 143 surrounds first "a" stage and at least partially surrounds the inner housing 103, middle housing 123, and outer housing 133.

The innermost air chamber 101 includes a first (proximate) end 106 on the side of the burner where the fuel conduit 102 enters the innermost air chamber 101 and extends to or into to the first mixing chamber 108. The first mixing chamber 108 includes a second (distal) end. As depicted in FIG. 1, the distal end of the first mixing chamber 108 opens into the third stage "c," which is composed of the second mixing chamber 201. Alternatively, the distal end of the first mixing chamber 108 can be capped but with ports drilled or otherwise formed in the cap to allow the air/fuel mixture to flow from the first mixing chamber 108 into the second mixing chamber 201.

Gas passes through the internal chambers during burner operation. The burner housings may be made of various metals commonly used in the construction of industrial burners, such as steel, stainless steel, alloys, and so on. The metal must be of a type and of internal dimensions that are capable of withstanding the heat produced by the burner, the type of fuel used, and the internal pressure.

It should be noted that air flows initially into the burner via the outermost coaxial (concentric) chamber 144. The air can be supplied using a blower (not shown in FIG. 1). The air in outermost chamber 144 splits, one portion flowing through conduit (aperture) 135 of the outermost housing 133 thus entering the second air inlet coaxial chamber 134. The second portion of air flows into air inlet coaxial chamber 146, which flows toward the swirl generator blades 207. The portion of air flowing through conduit 135 enters the second air inlet coaxial chamber 134, where the air splits, one portion flowing upstream toward the proximate end of the first inner mixing chamber 108 and a second portion flowing toward the distal end of the second air inlet coaxial chamber 134. Simultaneously, forced air moving upstream in second air inlet coaxial chamber 134 can move through ports 104 in the inner housing 103 both via the ports on the proximate end of the first inner mixing chamber as well as the ports 104 in the inner housing 103 located upstream of the fuel conduit's 105 cap as depicted for example in FIG. 1. It should be noted that the distal end 137 of the second air inlet coaxial chamber terminates lengthwise at approximately the same longitudinal distance as the distal end 127 of the first air inlet coaxial chamber 124. The middle housing 123 includes ports 125 which allow forced air to flow from the second air inlet coaxial chamber 134 into the first air inlet coaxial chamber 124. However, the distal end 127 of the first air inlet coaxial chamber can include ports 128 for air flow from the first air inlet coaxial chamber 123 directly into the pre-combustion zone 201. Air enters the first mixing chamber 101 via conduits 104 in inner housing 103 with fuel entering via conduit 102. The air and fuel begin to mix in the first mixing chamber 101 during use to form an air/fuel mixture. The air/fuel mixture in the first mixing chamber 101 flows through the distal opening of the first mixing chamber 101 into the second mixing chamber 201.

As shown in FIG. 1, the housings 103, 123, and 133 can converge in the downstream (distal) direction, thus forming conical chambers at portions before the opening of the first mixing chamber 101 into the pre-combustion chamber 201. The conical portion 138 is identified with respect to the outer housing 133. The first and second air inlet coaxial chambers 124, 134 both include conical portions, as does the outer surface of the first mixing chamber 101. The flare, which refers to the angle of convergence, of the conical portions can vary widely. However, irrespective of the exact angle, the converging flare forces the air/fuel mixture into a flow into a narrower passage before entering the second mixing chamber 201.

As stated above, the second stage comprises the second mixing chamber 201. The second mixing chamber can also be referred to as a pre-combustion zone. The second mixing chamber 201 includes at its distal end a deflection plate 202. The deflection plate 202 serves to force the air/fuel mixture outward from centerline "d" into the passage 204 defined by the deflection plate and the housing 205 which partially surrounds the first and second coaxial air inlet chambers and which also forms the second mixing chamber 201. The deflection plate 202 can be positioned by connecting the plate to rods 203, which can attach on the proximate side to the distal end of the first and second air inlet coaxial chambers. Other ways of affixing the deflection plate 202 may be used as long as gas flow is not interrupted.

The third stage defines a combustion zone 301 and generally also includes a swirl generator composed of blades 207. The blades 207 can take a variety of forms. As depicted in FIG. 1, the swirl generator includes a plurality of fins, blades, or the like, which cause the air to swirl as it flows downstream. In general, the swirl generator has an inner diameter greater than the outer diameter of the deflection plate 202. That is, the blades 207 are positioned such that their inner side is outside the outer diameter of the deflection plate 202. Thus air flowing through the swirl generator blades 207 contacts the air/fuel mixture flowing outward from the deflection plate 202. In FIG. 1, forward concentric chamber 146 is a narrower portion of outermost concentric chamber 144. A portion of air flowing through forward chamber 146 can flow both through and outwardly around the blades 207, with all air in forward chamber 146 flowing into the combustion zone 301 in stage "c" of the burner. Thus, gaseous flow comprising the air/fuel mixture moves during use around the deflection plate 202 into the combustion zone 301, wherein air passes through the swirl generator 207, wherein the air from the swirl generator 207 causes a flame generated during operation to swirl, whirl, and/or vortex. The swirl generator 207 may permit further mixing of the air/fuel mixture in the combustion zone 301. The swirl generator is encased by a forward housing 153, which serves to define the combustion zone 301. In FIG. 1, the forward housing 153 extends downstream and upstream of the deflection plate 202. Thus, the forward housing 153 also surrounds the second mixing chamber 201. In addition, FIG. 1 shows a coaxial (concentric) second mixing chamber housing 163 that serves to help define the second mixing chamber 201. The second mixing chamber housing 163 also serves to define the inner wall that defines air forward chamber 146 to the swirl generator blades 207.

The burner configuration of this invention improves the fuel burning, decreasing the amount of fuel required to heat a given space, thus decreasing heating costs in buildings such as greenhouses. In addition, the burner configuration of this invention improves the burn properties, reducing the odor of the gas downstream of the flame and combustion zone 301.

Also depicted in FIG. 1 is an optional flame ignitor 310. The ignitor can be integral with the burner. Alternatively, the ignitor can be handheld, used as needed. For reasons not understood at this time, unlike prior burners which include ignitors upstream in, for example, an internal mixing zone, the burner of this invention requires flame ignition to occur in the combustion zone 301 as represented in FIG. 1.

Figure 2:
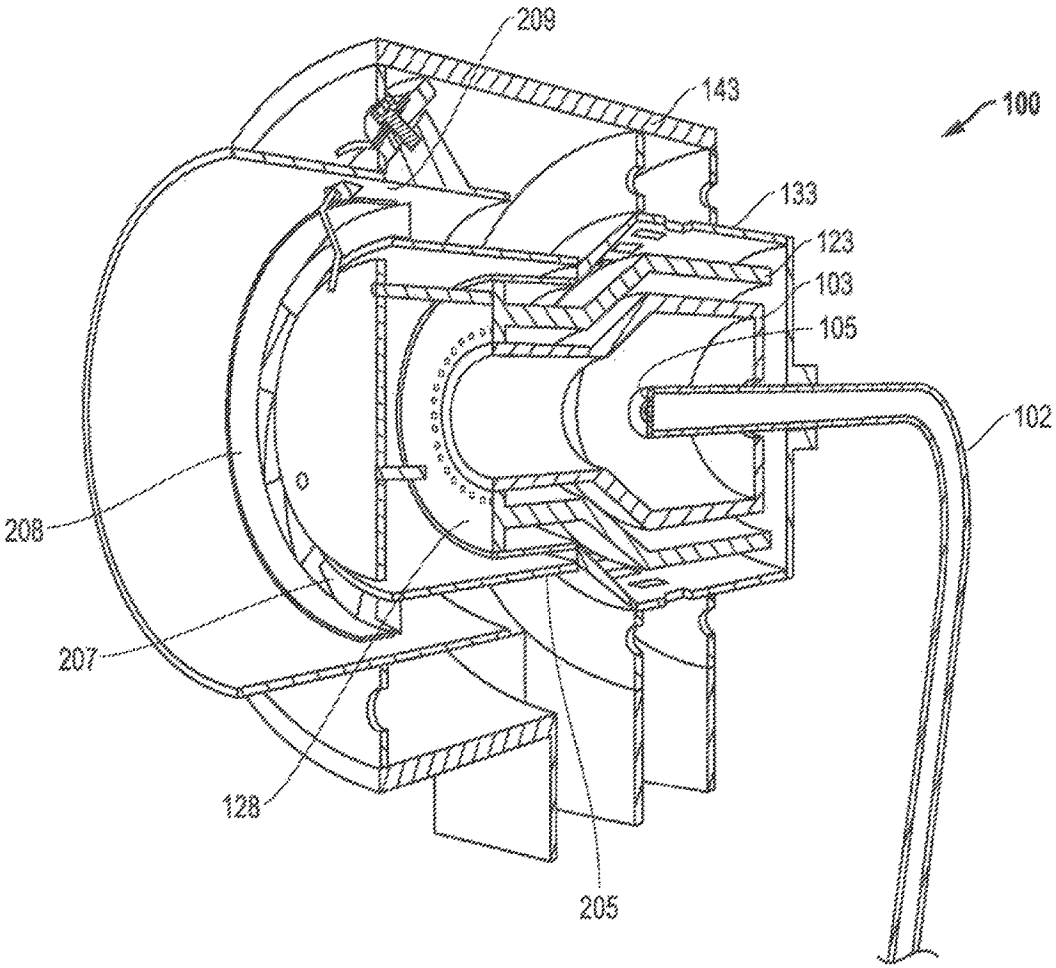
FIG. 2 shows a perspective, cross-sectional view along the centerline of the burner.

FIG. 2 depicts the burner body 100 in a perspective, cross-sectional view through the centerline. In this view the plurality of ports 128 are shown from a perspective, frontal view. In this embodiment, the ports 128 form a circular pattern around the centerline so that air evenly flows into the second mixing chamber 201. Similarly, FIG. 2 illustrates ports 105 on the front cap of the fuel conduit 102. The fuel conduit ports 105 are depicted in a circular pattern, but a variety of patterns can be used. FIG. 2 helps illustrate the concentric, coaxial configuration of the inner housing 103, middle housing 123, and outer housing 133.

Importantly, FIG. 2 shows the arrangement in one embodiment of the swirl generator blades 207, which can also be referred to as fins and the like. The number of blades 207 can vary depending on the size of the burner. Likewise, the size and dimensions of the blades 207 can vary, but in general attach to the housing 205 that helps form the pre-combustion chamber 201. The blades 207 attach at an angle to create a swirl as air moves through the swirl generator. The dimensions of the blades 207 are such that the blades extend outwardly from the centerline "d" from the housing 205 up to but not past the coaxial swirl generator housing 208, which is part of the swirl generator. As shown in FIG. 2, in one embodiment some air flows outwardly around the housing 208 through a gap 209 between the swirl generator housing 208 and the outermost coaxial housing 143. FIG. 2 also shows one embodiment of the rods 203 that serve to support and hold the deflection plate 202 in place. As depicted the deflection plate 202 has a circular design.

Figure 3:
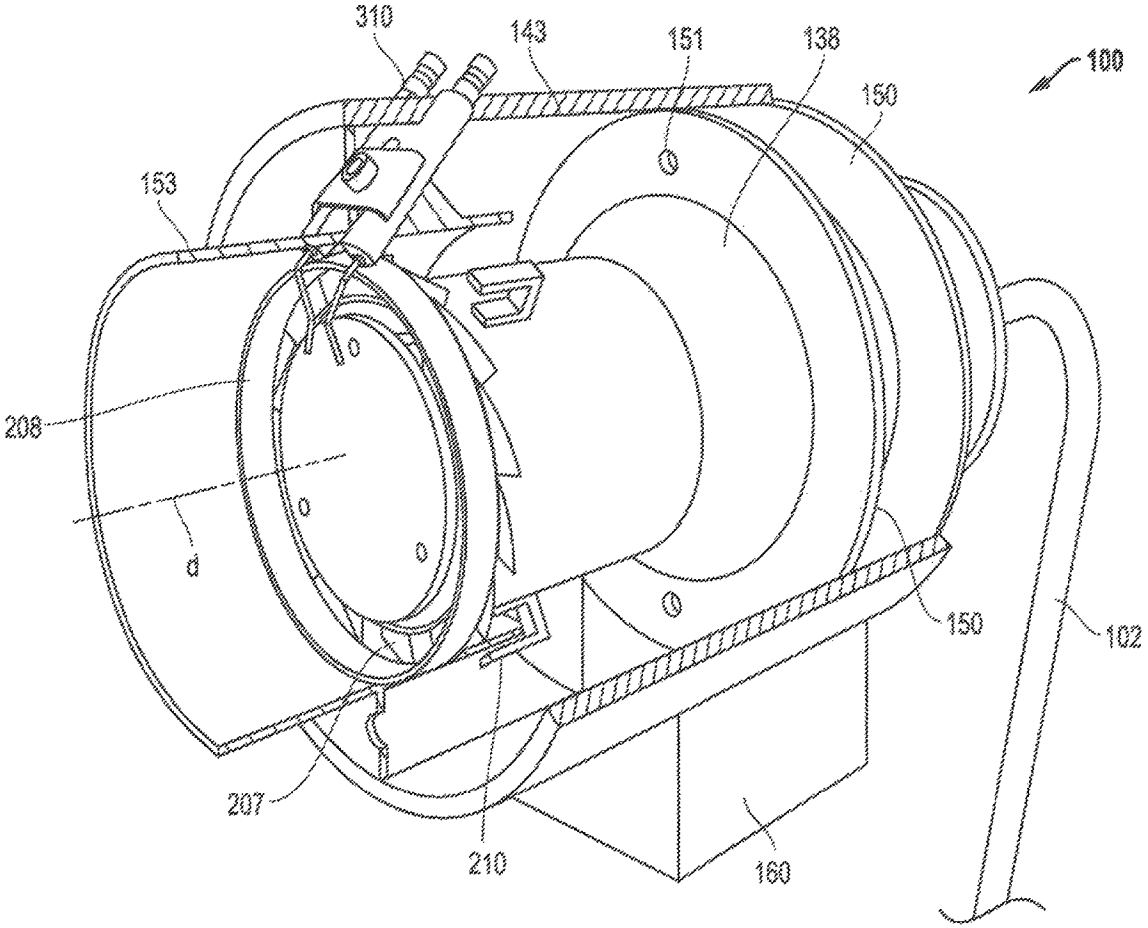
FIG. 3 shows the body of the burner 100 in a perspective, partial cross-sectional view. In particular, a portion of the outermost housing 143 has not been shows so that the outer surface of the conical section 138, for example, can be shown.

FIG. 3 illustrates the body of the burner 100 in a perspective, partial cross-sectional view. In particular, a portion of the outermost housing 143 has been removed to show the outer surface of the outer housing 133. As illustrated, the outer housing 133 connects to the outermost housing 143 by concentric flanges 150. The flanges 150 serve to seat the housings 103, 123, and 133 within the outermost housing 143. In addition, bores 151 in the flanges 150 permit air flow throughout the outermost chamber 144 so that air can flow through the blades 207 of the swirl generator as well as flow through conduit 135 into first and second air inlet coaxial chambers 124, 134, and inner mixing chamber 101. FIG. 3 includes line "d," which represents the centerline of the burner. Likewise, FIG. 3 shows brackets 210 (generally U-shaped) which serve to anchor the portion of the outermost housing 143 downstream of the fuel inlet 102 and of conical section 138 of the outer housing 133. The brackets 210 can be a variety of shapes and sizes depending on the size of the burner and so on. While other configurations are certainly possible, FIG. 3 shows the ignitor 310 bisecting outermost housing 143 and forward housing 153 so that the ignitor 310 extends into the combustion zone 301. The ignitor can be a conventional spark generator that permits fuel combustion to start the burner. FIG. 3 also shows lower conduit 160 that connects with a blower (not shown), which pumps air into the various inner chambers of the burner.

Figure 4:
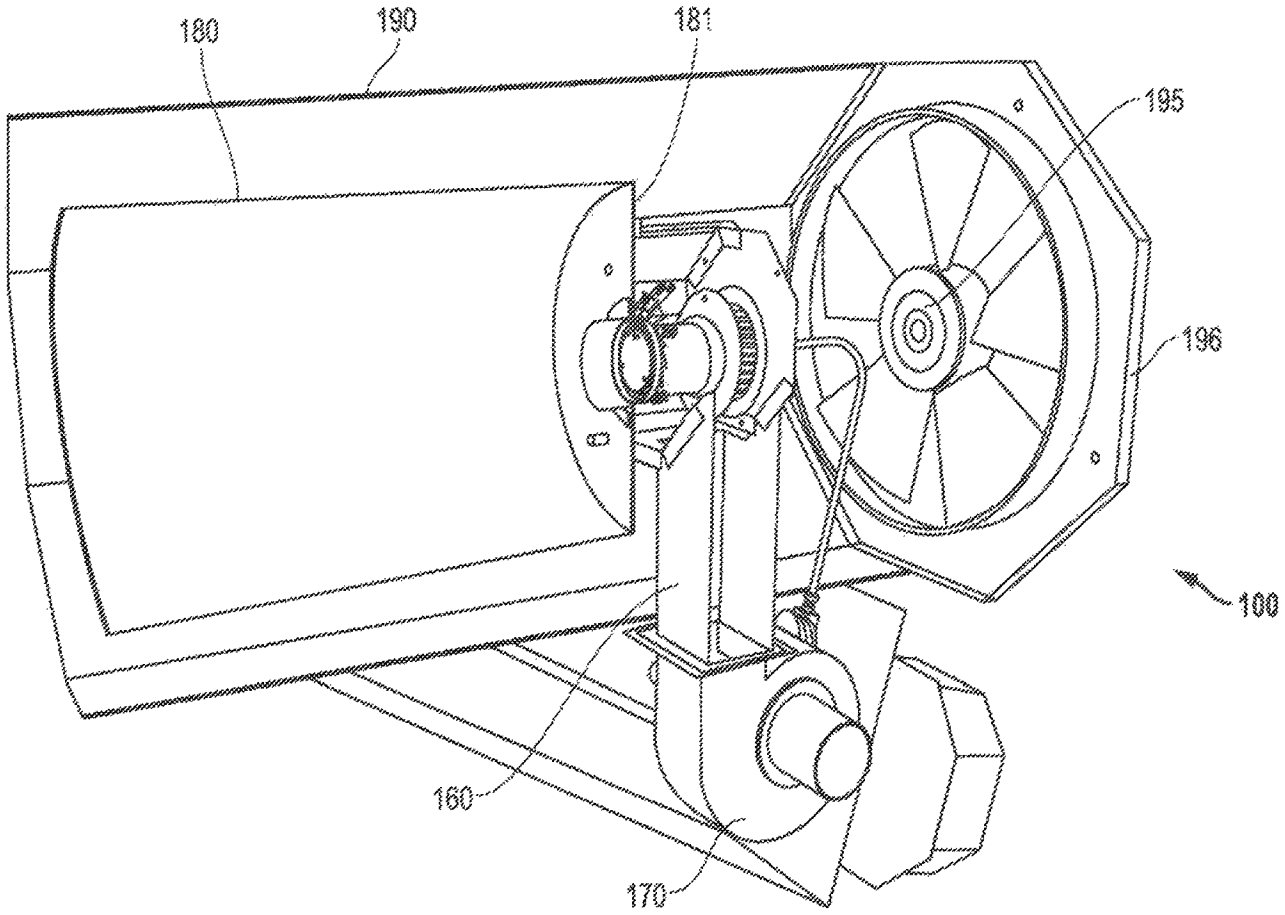
FIG. 4 shows a perspective, partial, cross-sectional view of the burner mounted within a heater housing assembly.

FIG. 4 shows a perspective, partial, cross-sectional view of the burner body 100 mounted within a heater housing assembly. In FIG. 4, multiple inner housings are not depicted so that fan 195 can be fully shown. The fan 195 is upstream from the burner 100. The outer flange 196 of the fan 195 connects to casing 190 that surrounds the burner 100 as well as flame casing 180. When operating, a flame ignited in the combustion zone 301 will protrude downstream of the forward housing 153, extending into the flame space defined by the flame casing 180 and flame casing wall 181. The burner 100 protrudes through the flame casing wall 181 into the flame space.

In addition, FIG. 4 shows a blower 170 which attaches to lower air conduit 160. The blower 170 thus supplies air to the burner 100. The blower can be of conventional design, sized according to the type and size of the burner as well as heating requirements.

During operation while the burner 100 is propagating a flame into the flame space defined by flame casing 180 and flame casing wall 181, the fan 195 can be running so that air flows over the outer surface of the flame casing 180. In this way heat is transferred not only through the flame space defined by the flame casing 180, but also transfers heat from convection through flame casing 180 so that this additional heat is captured and transferred to the area, such as a greenhouse, to be heated.

Figure 5:
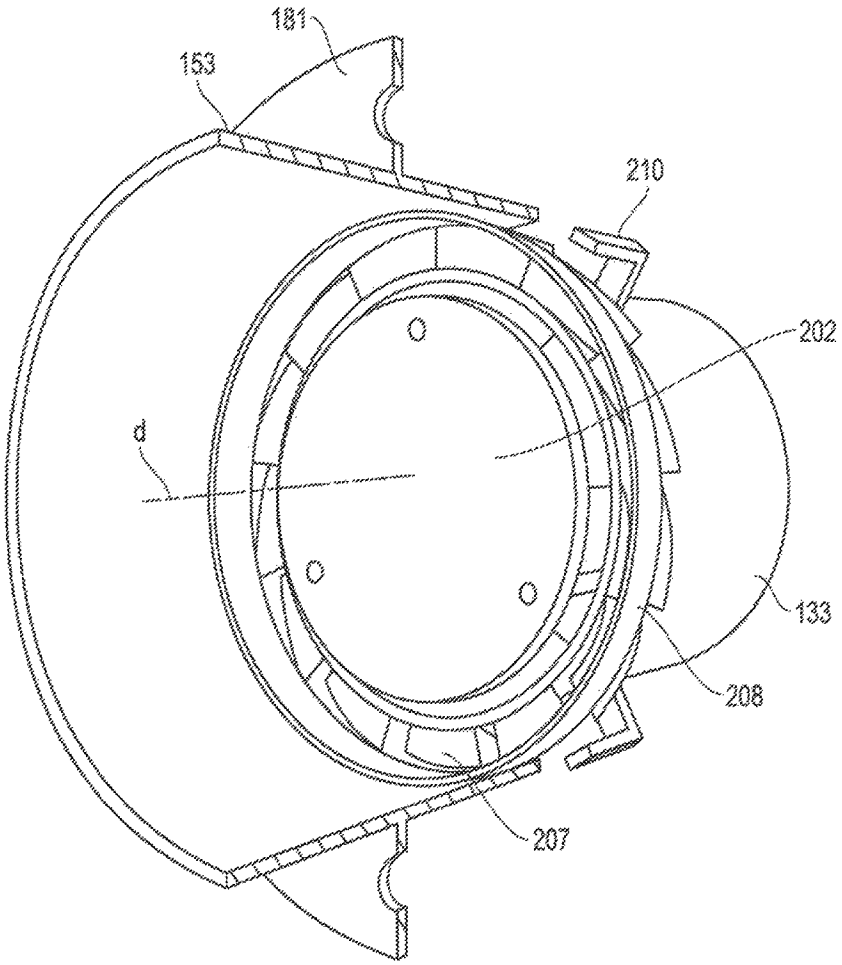
FIG. 5 shows a perspective view of the swirl generator portion of the burner.

FIG. 5 shows a perspective, partially cross-sectional view of the swirl generator portion of the burner. Thus in FIG. 5, forward casing 153 surrounds, in a coaxial configuration, the housing 208 and deflector plate 202 as well as the blades 207 of the swirl generator. FIG. 5 provides a closer more detailed perspective view of this section of the burner 100.

Figure 6:
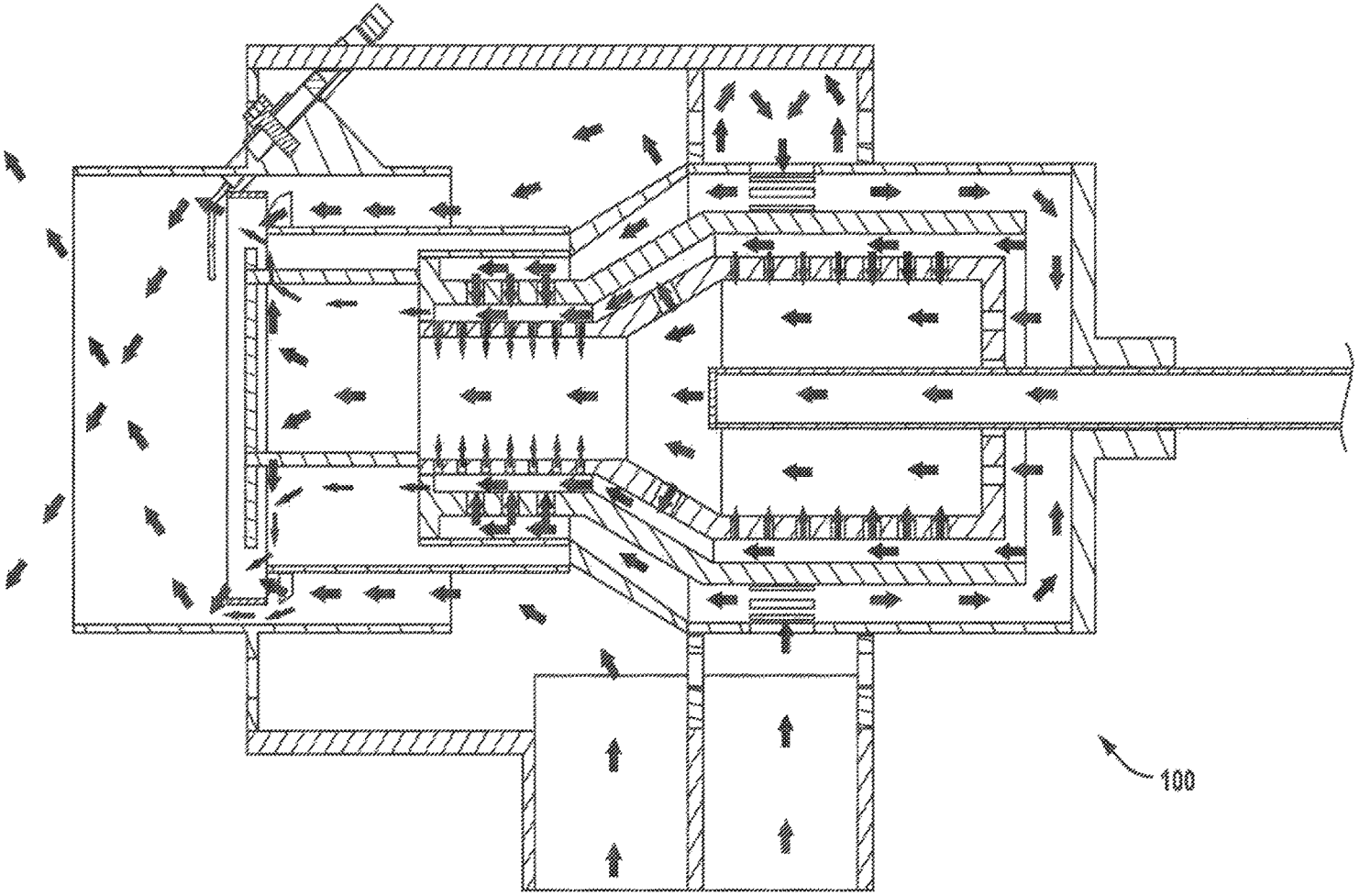
FIG. 6 shows a cross-sectional view of the burner 100 which illustrates gas flow during use.

FIG. 6 shows a cross-sectional view of the burner 100 which illustrates gas flow during use. Gas flow is depicted by arrows. During operation of the burner, fuel enters the first mixing zone 108 through the fuel conduit 102. Simultaneously, air from blower (not shown in this FIG.) moves through lower conduit 160, moving through conduit 135 into the outer air inlet coaxial chamber 134. Air also flows from lower conduit 160 into forward chamber 146, which flows through the swirl generator 207 as well as the gap between the blades 207 and the forward housing 153. Air that flows through aperture 135 flows upstream and downstream, thus moving through the ports 125, 104 so that the air enters the middle chamber 124 and the innermost air chamber 101 both upstream and downstream of the cap 105 of the fuel line 102. Fuel and air begin to mix in first mixing chamber 108 with the air/fuel mixture flowing into the second mixing chamber 201, further mixing with air that enters the second mixing chamber via ports 128. The resulting air/fuel mixture flows outwardly around the deflection plate 202 into the combustion zone 301 where the air/fuel mixture ignites to form a flame. Primary air that flows through the blades 207 of the swirl generator create a vortex or whirl of the flame, and also can facilitate additional mixing of fuel and air. Once lit, the flame propagates downstream (distal) of the deflection plate 202.

Further modifications and alternative embodiments of this invention will be apparent to those skilled in the art in view of this description. It will be recognized, therefore, that the present invention is not limited by these example arrangements. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the implementations and architectures. For example, equivalent elements may be substituted for those illustrated and described herein, and certain features of the invention may be utilized independently of the use of other features, all as would be apparent to one skilled in the art after having the benefit of this description of the invention.

What is claimed is:

1. A burner device, comprising:

an innermost air chamber;

a first inner mixing chamber which is distal to the innermost air chamber, and a second inner mixing chamber which is distal to the first mixing chamber;

a first air inlet coaxial chamber which surrounds the innermost air chamber and the first mixing chamber;

a second air inlet coaxial chamber which surrounds the first air inlet coaxial chamber;

a third air inlet coaxial chamber which surrounds the second air inlet coaxial chamber and the second mixing chamber, said third air inlet coaxial chamber including ports for air to flow into the second air inlet coaxial chamber;

a deflection plate positioned on the distal end of the second mixing chamber;

wherein the second mixing chamber connects to a combustion zone which is distal from the second mixing chamber;

wherein said third air inlet coaxial chamber has a distal end that connects to a coaxial static swirl generator; and a fuel conduit extending up to the first inner mixing chamber through an opening in the innermost air chamber;

wherein the first mixing chamber has a first end and a second end, said second end being downstream from the first end, and said second end opening into the second mixing chamber.

2. The device of claim 1, wherein said first air inlet coaxial chamber includes ports that allow air to flow from the first air inlet coaxial air inlet chamber into the innermost mixing chamber and the first mixing chamber, and wherein said first air inlet coaxial chamber has a distal end coterminous with the second end of the first inner mixing chamber.

3. The device of claim 1, wherein said distal end of the second air inlet coaxial chamber is coterminous with the distal end of the first air inlet coaxial chamber, and said second air inlet coaxial chamber including ports for air to flow into the first air inlet coaxial chamber.

4. The device of claim 1, wherein the deflection plate is circular.

5. The device of claim 1, wherein the deflection plate has an outer diameter less than the outer diameter of the second mixing chamber, and wherein the outer diameter of the circular deflection plate is greater than the outer diameter of the first inner mixing chamber.

6. The device of claim 1, wherein the outer diameter of the deflection plate is coaxial with the centerline, and wherein the deflection plate during operation directs the flow of the air/fuel mixture outward from the centerline and into the combustion zone.

7. The device of claim 1, wherein said coaxial static swirl generator comprises fins configured to direct air flow into the combustion zone.

8. The device of claim 1, wherein said static coaxial swirl generator has an inner diameter greater than the outer diameter of the deflection plate.

9. The device of claim 1, wherein said static coaxial swirl generator is positioned co-longitudinal along the centerline with the deflection plate.

10. The device of claim 1, wherein a portion of the first air inlet chamber and the second air inlet chamber converge downstream.

11. The device of claim 1, including ports that allow to gaseous interchange between the first inner mixing chamber and the first air inlet coaxial air inlet chamber.

12. The device of claim 1, wherein the first and second air inlet coaxial chambers have ends at same distance distally along the centerline.

13. The device of claim 1, wherein said second air inlet coaxial chamber includes ports for gaseous interchange with the first air inlet coaxial chamber.

14. The device of claim 1, wherein said third air inlet coaxial chamber couples to an air blower.

15. The device of claim 1, wherein said second air inlet coaxial chamber includes at least one distal opening for air to flow into the second mixing chamber.

16. The device of claim 1, further comprising an ignitor positioned within the combustion zone.

* * * * *